US006893067B1

(12) United States Patent
Ayala

(10) Patent No.: US 6,893,067 B1
(45) Date of Patent: May 17, 2005

(54) HOLDER FOR A CONCRETE SLURRY HOSE

(76) Inventor: Henry Ayala, 2023 Los Feliz Dr., Apt. 5, Thousand Oaks, CA (US) 91362

( * ) Notice: Subject to any disclaimer, the term of this patent is extended or adjusted under 35 U.S.C. 154(b) by 33 days.

(21) Appl. No.: 10/768,282

(22) Filed: Jan. 29, 2004

(51) Int. Cl.[7] ..... B65G 7/12
(52) U.S. Cl. ..... 294/15; 294/150; 294/157; 294/165; 248/75
(58) Field of Search ..... 294/15, 16, 142, 294/150, 153, 154, 157, 165; 248/75–79

(56) References Cited

U.S. PATENT DOCUMENTS 479,841 A * 8/1892 Robinson ..... 248/76
622,246 A * 4/1899 Matheas ..... 248/78
633,899 A * 9/1899 Peacock ..... 248/78
1,686,115 A * 10/1928 Anderson ..... 294/15
2,919,071 A * 12/1959 Dalton ..... 239/273
4,838,465 A * 6/1989 Metzger ..... 222/526

* cited by examiner

*Primary Examiner*—Dean J. Kramer
(74) *Attorney, Agent, or Firm*—Jack C. Munro

(57) ABSTRACT

A holder for a concrete slurry hose connectable to support a hose for dispensing a slurry at an elevated location such as at the top of a wall. The holder comprises an elongated body which is to be supported at the top of the wall. The body includes a pair of straps which would be secured to the hose some spaced distance from the dispensing end of the hose. The lower end of the body includes a pair of handles. These handles are to be grasped and used by a human to facilitate movement of the body to various locations along the wall.

3 Claims, 1 Drawing Sheet

HOLDER FOR A CONCRETE SLURRY HOSE

BACKGROUND OF THE INVENTION

1. Field of the Invention

The field of this invention relates to holders and more particularly to a holder for a hose which is designed to dispense a concrete slurry at an elevated location.

2. Description of the Related Art

The present invention is discussed in relation to a slurry. This slurry, though flowable, is not totally liquid. For example, it is common to mix water, cement and sand into a slurry and then pump that slurry through a hose to be dispensed at a desired location. This dispensing of slurry is exceedingly common in the construction industry. Although the present application is discussed in terms of dispensing a slurry, it is considered to be within the scope of this invention that this is to include any kind of a flowable medium.

Within the construction industry, it is common to pump a cement slurry through a hose to be dispensed at a desired location. One of these desired locations is within a block wall. Blocks, either cement or cinder, have enlarged center openings. It is common that when the wall is constructed to its desired height, such as six feet, that a cement slurry is pumped into the openings within the blocks at the top of the wall with this slurry then flowing all the way through the openings of the blocks to the lower level of the wall. When the cement slurry hardens, an extremely strong wall structure is produced.

The normal manner of pumping this cement slurry into the openings in the top of the wall is for a human to stand on the top of the wall and hold the dispensing end of the hose and fill one opening and then move such to another opening and so forth. This hole will normally extend from the ground, such as six feet, with an additional three to four feet being held by the human above the wall during the dispensing process. This means that the human is supporting nine to ten feet of this hose which is filled with slurry. The combined weight of the hose and slurry is generally in excess of one hundred pounds. To fill the openings along an entire length of wall may take several minutes and maybe even hours. Because of the weight and the time involved plus the fact that the dispensing of the slurry is constant, this procedure becomes quickly physically exhausting to the human. It is not at all uncommon for the back of the human to just "give out".

In the past, there have been attempts in designing some type of a hose holder to facilitate this dispensing operation. One type of such a hose holder comprise a U-shaped tube to which the hose is to be attached and the slurry to be flowed through this tube. The tube is to be supported on the wall. The slurry is to be dispensed from the outer free end of the tube with this outer free end adapted to connect with an opening in a block within the top row of blocks of the wall. Attached to the tube and extending upwardly therefrom is a handle. A human is to maneuver himself along the wall and repeatedly pick up this tube by the handle to move the tube to new opening locations. The advantage of this type of hose holder is that it does provide a break for the individual from continuously holding the hose since the human is not holding the hose during the filling operation. However, a substantial lifting force is required each time the hose holder is moved to a new location since the human must not only lift the weight of the hose holder and the hose extending to the ground but also the weight of the slurry within both the hose holder and the hose that goes to the ground.

Also, during the last filling operation, it is desirable to precisely turn off the flow of the slurry when this last opening is filled. However, this precise shutting down of the flow very seldom occurs with a result that an over-filling occurs. This over-filling results in the cement slurry flowing down along the outside surfaces of the wall which then requires that this portion of the wall must be cleaned. There is no way to conveniently direct this flow in a different direction from this hose holder since the hose is not held by one's hand and the dispensing end of the hose holder is rigid and is designed to flow only in a downward direction into the openings of the blocks of the wall. If redirection could occur, the user would only need to point the dispensing nozzle of the hose in a direction away from the wall which would prevent the outside surface of the wall from becoming contaminated.

SUMMARY OF THE INVENTION

The structure of the present invention comprises a holder which has an elongated U-shaped body defining an inner leg and an outer leg. The outer leg is of substantial increased length over the inner leg. The inner leg is designed to just engage with one of the openings (an opening that has not been filled with slurry) within the upper edge of a block wall. The outer leg has mounted thereon in an outwardly extending manner a pair of spaced apart handle members. These handle members are to be grasped by a human standing on the ground adjacent the wall and are to be used by this human to facilitate lifting of the hose holder to be disengaged from one opening to then be re-engaged with another opening. Mounted in conjunction with the outer lege are a pair of spaced apart strap and buckle arrangements. These strap and buckle arrangements are to be tightly bound onto the hose which is conventionally used to dispense the slurry. A certain length of the hose extends above the hose holder, such as three to four feet, which terminates in a dispensing end, generally in a dispensing nozzle. This length of hose is to be held by a second human moving along the upper edge of the wall. It is the purpose of this human to manipulate the dispensing end to sequentially fill the openings along the top edge of the wall. As this filling procedure is being completed, the human standing on the ground sequentially moves the hose holder consistent with the filling procedure.

The primary objective of the present invention is to construct a holder which is adaptable to a conventional slurry dispensing hose not requiring any modifications thereof.

Another objective of the present invention is to construct a holder in which the human manipulating the dispensing end of the hose physically carries only a small amount of weight during the dispensing process.

Another objective of the present invention is to construct a holder which permits the dispensing end of the hose to be easily and quickly manipulated in any desired direction including directing the flow away from the dispensing location if such is deemed to be desired.

Another objective of the present invention is to construct a holder of few parts and of uncomplicated parts so that the holder can be manufactured inexpensively and thereby sold to the ultimate consumer at an inexpensive price.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
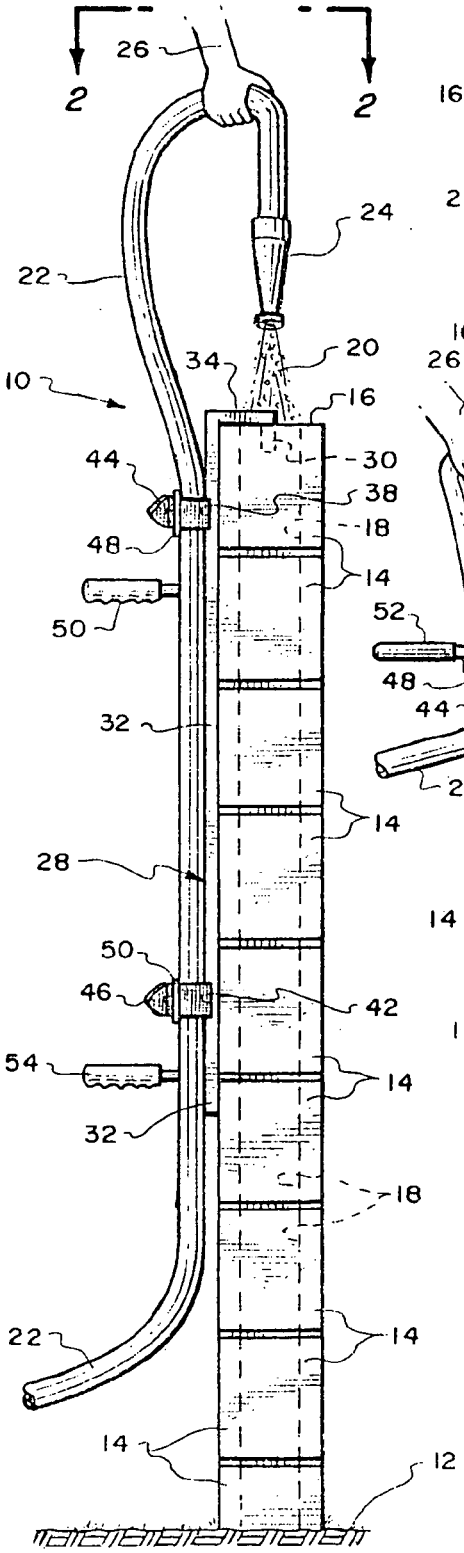
FIG. 1 is a side elevational view of a block wall wherein the hose holder of the present invention is being utilized to dispense a cement slurry at the top edge of the wall.

Referring particularly to the drawing, there is shown a conventional block wall 10 which is constructed on the ground 12. The block wall 10 defines a top edge 16. The block wall 10 is constructed of a plurality of identical cement or cinder blocks 14. Each block 14 has a pair of internal openings 18.

The openings 18 are to be filled with a cement sand slurry 20. This slurry 20 is to be supplied into each of the openings 18 from a source (not shown) through a rubber or other flexible material hose 22. Hose 22 terminates at its outer free end in a nozzle 24 through which the slurry 20 is to be dispensed through the opening. The hose 22 adjacent nozzle 24 is to be supported by a human such as depicted by the human hand 26.

Figure 2:
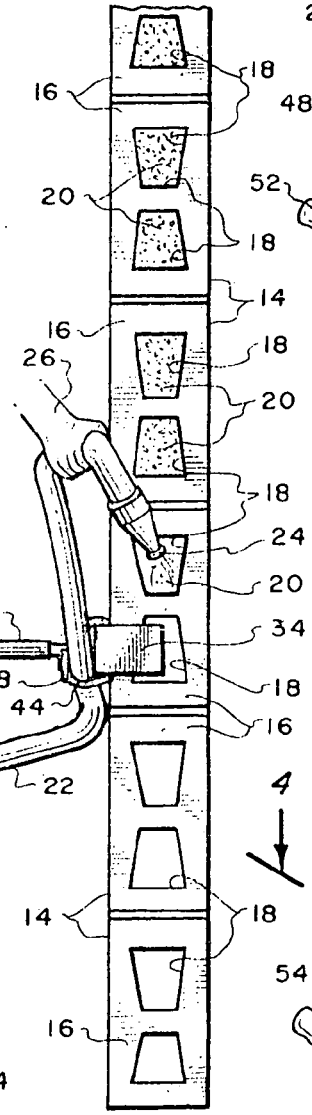
FIG. 2 is a top plan view taken along line 2—2 of FIG. 1.
Figure 3:
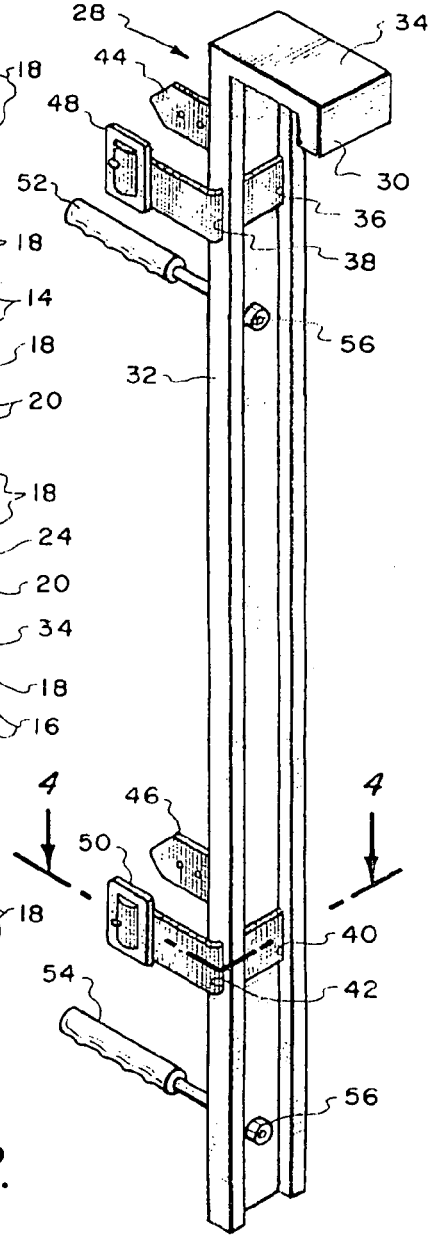
FIG. 3 is a rear directioned isometric view of the hose holder of the present invention with the dispensing hose not being shown attached thereto.
Figure 4:
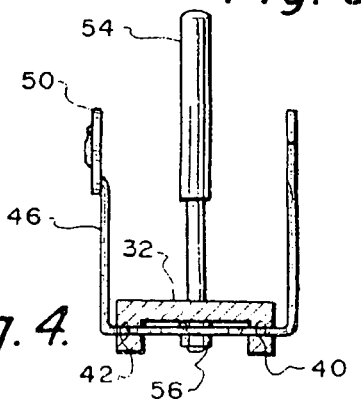
FIG. 4 is a cross-sectional view taken along line 4—4 of FIG. 3.

The hose holder 28 of this invention is designed to remove the bulk of the weight that the user carries during the filling of the openings 18 with the slurry 20. Hose holder 28 of this invention is formed of an elongated channel-shaped body. This body is basically U-shaped and is defined by an inner leg 30 and an outer leg 32 which are connected by an apex section 34. The inner leg 30 is shown to be of a substantially short length while the outer leg 32 is substantially of a longer length. A typical length for leg 30 would be two to three inches while leg 32 will be three to four feet. The width of the apex section 34 will normally also be within the range of four inches. It is to be noted that leg 30 is parallel to the leg 32. The leg 30 is positioned so to just be able to fit within one of the openings 18 as is clearly shown in FIG. 2 of the drawing. This position supports the hose holder 28 of this invention on the wall 10.

Within the leg 32 there are formed a pair of aligned slots 36 and 38 and a similar pair of aligned slots 40 and 42. The aligned slots 40 and 42 are spaced some distance from the aligned slots 36 and 38. Connecting with the aligned slots 36 and 38 is a conventional strap 44 which is to be made of a nylon, plastic, leather or other similar type of material. A similar such strap 46 connects with the aligned openings 40 and 42. Straps 44 and 46 are essentially identical. Strap 44 includes a buckle 48. Strap 46 including a buckle 50.

The hose 22 is to be positioned directly against the leg 32. This positioning of the hose 22 will normally be so that there will be approximately three to four feet of the hose 22 that extends above or away from the hose holder 28. The straps 44 and 46 are then wrapped around the hose 22 with the buckles 48 and 50 utilized in a manner to tighten the straps 44 and 46 thereby fixing in position the hose 22 onto the leg 32. At this particular time, the bulk of the weight of the hose 22 is now carried by the hose holder 28.

In order to facilitate manual movement of the hose holder 28 from one opening 18 to another opening 18, there is fixedly mounted onto the leg 32 a pair of identical handle members 52 and 54. Handle members 52 and 54 are located parallel and extend in an outward direction away from the wall 10. Generally, the handle members 52 and 54 are spaced apart approximately two to two and one-half feet. The inner end of both handle members 52 and 54 include a threaded section which passes through a hole formed within the leg 32 and connects with a nut 56. Tightening of each nut 56 is to fixedly secure the handle members 52 and 54 onto the leg 32. It is to be understood that there is a separate nut 56 for each handle member 52 and 54.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. In combination with a hose for dispensing of a slurry onto a fixed structure at an elevated location, said hose having a free outer end, said dispensing occurring from said free outer end, a holder for said hose to facilitate manual dispensing by a human of the slurry, said holder comprising:

an elongated body having an upper end and a lower end, said elongated body being substantially U-shaped defining an outer leg and an inner leg, said outer leg being located substantially parallel to said inner leg and being spaced from said inner leg, said outer leg being substantially longer in length than said inner leg, said inner leg to be supportingly positioned in a fixed position on said fixed structure at said elevated location;

hose securement means mounted on said body, said hose securement means being fixable onto said hose some spaced distance from said free outer end, said hose securement means comprising a pair of straps, said straps being adjustably tightenable onto said hose; and handle means mounted on said body at said lower end, said handle means being graspable by a human to facilitate lifting and moving of said elongated body and said hose relative to said fixed structure to permit repositioning of said body at a new location on said fixed structure, said handle means comprising a pair of spaced apart handle members.

2. The combination as defined in claim 1 wherein:

said handle members extending outward from said fixed structure.

3. The combination as defined in claim 2 wherein:

said handle members being located substantially parallel to each other.

* * * * *